US008876112B2

(12) United States Patent
Skinner

(10) Patent No.: US 8,876,112 B2
(45) Date of Patent: Nov. 4, 2014

(54) DRY-ERASABLE GAME BOARD

(71) Applicant: Crayola LLC, Easton, PA (US)

(72) Inventor: Craig Skinner, Easton, PA (US)

(73) Assignee: Crayola LLC, Easton, PA (US)

( * ) Notice: Subject to any disclaimer, the term of this patent is extended or adjusted under 35 U.S.C. 154(b) by 0 days.

(21) Appl. No.: 13/671,979

(22) Filed: Nov. 8, 2012

(65) Prior Publication Data

US 2013/0116035 A1 May 9, 2013

Related U.S. Application Data

(60) Provisional application No. 61/556,908, filed on Nov. 8, 2011.

(51) Int. Cl.
*A63F 3/00* (2006.01)

(52) U.S. Cl.
USPC ..... 273/239; 273/240

(58) Field of Classification Search
USPC ..... 273/239, 240
See application file for complete search history.

(56) References Cited

U.S. PATENT DOCUMENTS 5,478,084 A * 12/1995 Itkis ..... 273/239
5,531,600 A * 7/1996 Baer et al. ..... 434/317
5,741,561 A * 4/1998 Lenkin ..... 428/13
5,762,338 A * 6/1998 Hutchison ..... 273/247
6,254,098 B1 * 7/2001 Kirkpatrick ..... 273/271
6,702,375 B1 * 3/2004 Laskowski et al. ..... 297/188.07
7,350,781 B2 * 4/2008 Shalit ..... 273/240
7,490,833 B2 * 2/2009 Harris et al. ..... 273/243
7,887,057 B1 * 2/2011 Brodie et al. ..... 273/242
8,118,306 B2 * 2/2012 Kean ..... 273/239
2002/0024177 A1 * 2/2002 Fikki ..... 273/256
2006/0226603 A1 * 10/2006 Webber, Jr. ..... 273/239
2009/0243214 A1 * 10/2009 Kean ..... 273/239
2013/0106055 A1 * 5/2013 Knox ..... 273/239

* cited by examiner

*Primary Examiner* — Vishu K. Mendiratta
(74) *Attorney, Agent, or Firm* — Shook, Hardy & Bacon L.L.P.

(57) ABSTRACT

A travel game-board activity kit is provided. The activity kit includes a plurality of dry-erase marking instruments, a plurality of magnetic game pieces, and a plurality of pages having game-board images printed thereon. The plurality of pages includes one or more magnetic sections, and a surface configured to accept markings from the plurality of dry-erase marking instruments and to allow erasure of the markings. The surface of the plurality of pages that accepts dry-erase markings may also include one or more dry-erase sections configured to aid players in tracking game progress, such as on a dry-erase scoreboard. The activity kit may also include a storage container attached to the plurality of pages, which holds the dry-erase marking instruments and/or the magnetic game pieces. In some embodiments, the activity kit includes an electronic component coupled to the plurality of pages for providing desired information, lights, and/or sounds usable for play.

18 Claims, 3 Drawing Sheets

DRY-ERASABLE GAME BOARD

CROSS-REFERENCE TO RELATED APPLICATIONS

This application claims priority to U.S. Provisional Patent Application No. 61/556,908, entitled "Dry-Erasable Game Board," filed Nov. 8, 2011, the disclosure of which is hereby incorporated by reference in its entirety.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief and at a high level, this disclosure describes, among other things, a book, pamphlet, or other printed media having a dry-erasable surface and one or more magnetic portions on or in the pages thereof. One or more images associated with a game board or game play is printed on the pages. Dry-erase marking implements and magnetic game pieces are provided for game play and/or score keeping. The book and games are configured for use as travel activities and may be designed for shorter play duration than a standard game.

DESCRIPTION OF THE DRAWINGS

Illustrative embodiments of the invention are described in detail below with reference to the attached drawing figures, and wherein.

DETAILED DESCRIPTION

Figure 1:
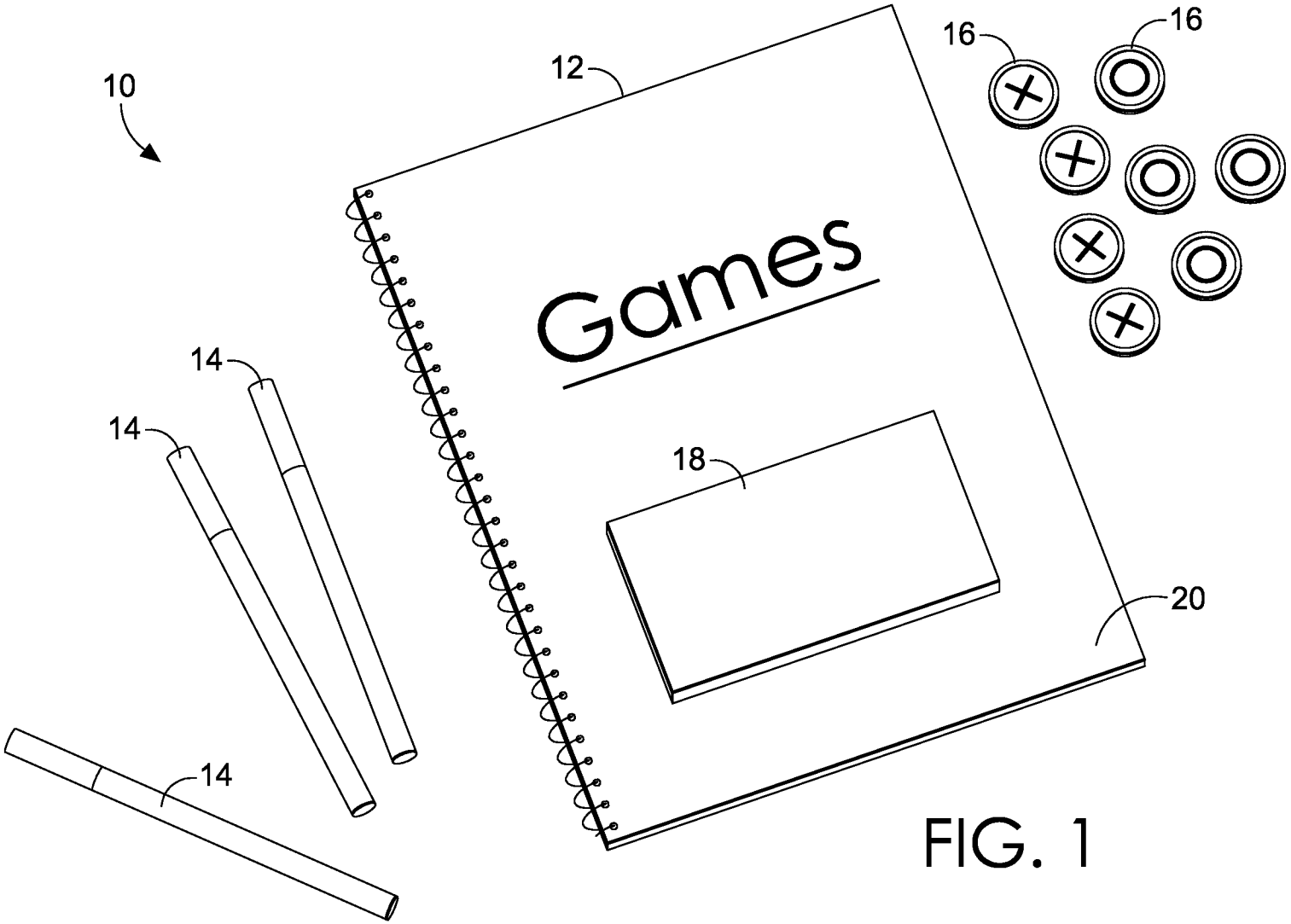
FIG. 1 is a perspective view of dry-erasable game kit in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Embodiments of the invention relate to a book, pamphlet, or other printed media having a dry-erasable surface and one or more magnetic portions on or in the pages thereof. One or more images associated with a game board or game play is printed on the pages. Dry-erase marking implements and magnetic game pieces are provided for game play and/or score keeping. The book and games are configured for use as travel activities and may be designed for shorter play duration than a standard game.

In one embodiment, a travel game-board activity kit comprises a plurality of dry-erase marking instruments; a plurality of magnetic game pieces; and a plurality of pages having one or more game-board images printed thereon, one or more magnetic sections, and a surface configured to accept markings from the plurality of dry-erase marking instruments and to allow erasure of the markings.

In another embodiment, a travel game-board activity kit comprises one or more dry-erase marking instruments; one or more removeably attachable game pieces; and a plurality of pages having one or more game-board images printed thereon, one or more attachment surfaces adapted to couple to the one or more game pieces, and a surface configured to accept markings from the one or more dry-erase marking instruments and to allow erasure of the markings.

In a further embodiment, a travel game-board activity kit comprises a plurality of dry-erase marking instruments, wherein the marking instruments are one or more of dry-erase markers and dry-erase crayons; a plurality of magnetic game pieces; a plurality of pages having one or more game-board images printed thereon, one or more magnetic sections, and a surface configured to accept markings from the plurality of dry-erase marking instruments and to allow erasure of the markings, wherein the surface configured to accept markings from the plurality of dry-erase marking instruments comprises one or more dry-erase sections configured to aid players in tracking game progress, wherein the one or more dry-erase sections are labeled according to a score-keeping format of the corresponding one or more game board images; and an electronic component coupled to at least one of the plurality of pages, wherein the electronic component comprises a liquid-crystal display, an actuation button, and one or more of an associated processor, a memory, and an integrated circuit board, wherein the electronic component is configured to generate one or more of desired information, sounds, and lights that are usable for game play, and further wherein the electronic component is integrated into a first page of the plurality of pages, wherein subsequent pages include a cut-out that allows the electronic component to pass through the subsequent pages such that the electronic component can be viewed when the subsequent pages are turned.

Referring initially to FIG. 1, a dry-erase activity kit 10 is depicted in accordance with an embodiment of the invention. The kit 10 includes a game book 12, one or more dry-erasable marking instruments 14, one or more game pieces 16, a storage container 18, and a cover page 20. Embodiments of the invention are described herein as comprising a book 12. However, embodiments can include any form of printed media, such as a pamphlet, poster, folder, or the like. The book 12 is bound in any desired manner, but in some embodiments the binding is configured to enable the book 12 to be opened and laid flat, e.g. a spiral, wire binding.

Figure 2:
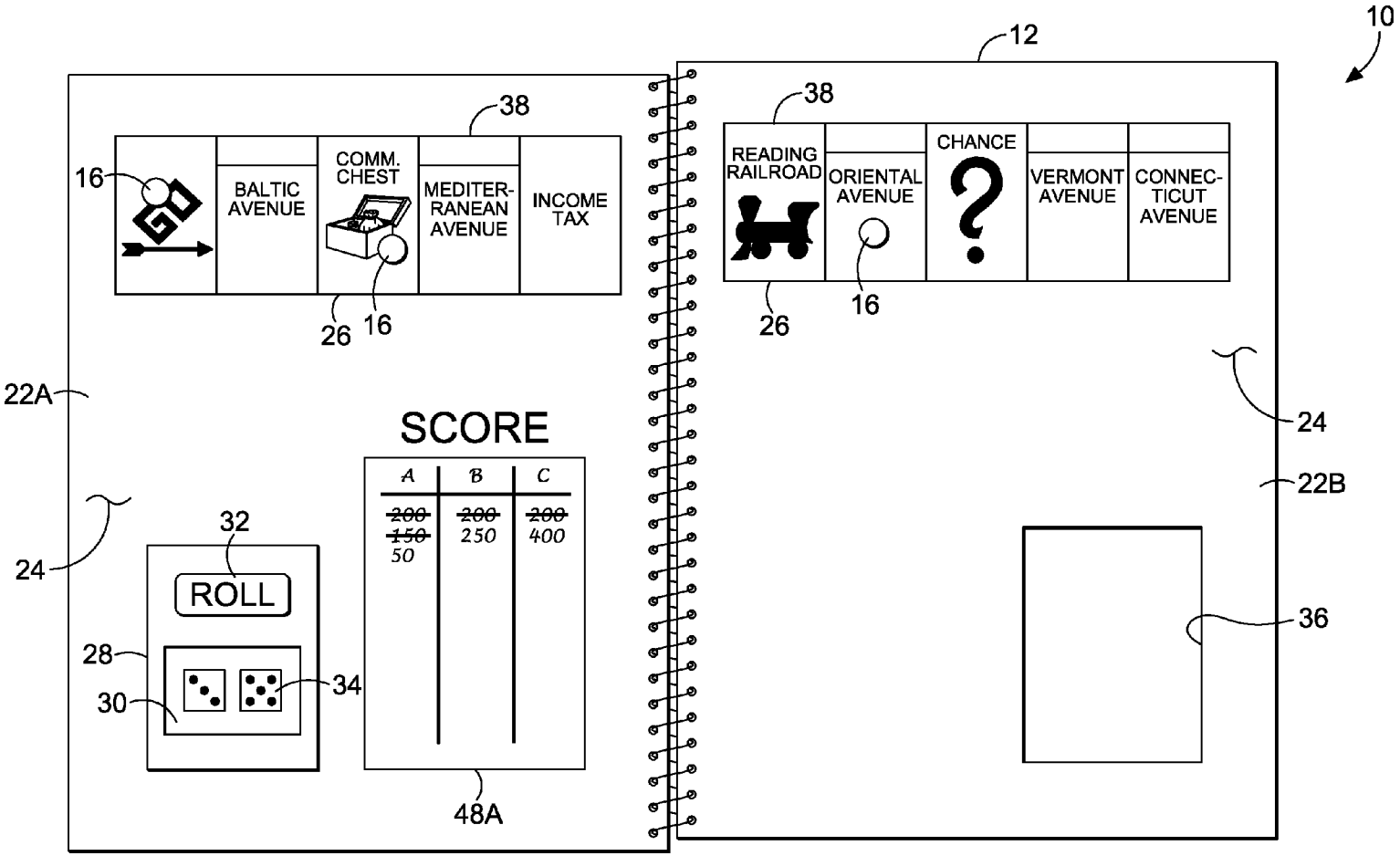
FIG. 2 is a perspective view of a dry-erasable game kit with an integral electronic component in accordance with an embodiment of the invention.

With additional reference to FIG. 2, pages 22*a-b* of the game book 12 are constructed from a substantially rigid cardboard, paperboard, or plastic, but can be constructed from any desired material. In embodiments, surfaces 24 of the pages 22*a-b* are configured to accept markings from the marking instruments 14 and to allow erasure of those markings. The pages 22*a-b* may include one or more magnetic sections 26 to which game pieces 16 can be magnetically coupled. The magnetic sections 26 are formed integral to or superficially on the pages 22*a-b* by methods known in the art.

The dry-erasable marking instruments 14 comprise any available marking instruments useable to provide erasable marks on the pages of the game book 12, such as on the pages 22*a-b* of the game book 12. In an embodiment, the marking instruments 14 include dry-erase markers or dry-erase crayons. In another embodiment, the marking instruments 14 include a light source, e.g. an LED light, and the pages 22*a-b* are configured with photoluminescent or photochromic inks or dies.

In embodiments, the activity kit 10 includes a plurality of the game pieces 16. The game pieces 16 can take any desired form including tokens, medallions, miniature figurines, and the like. The game pieces 16 may be magnetic or include another means for removable attachment to pages 22*a-b* of the game book 12, such as pressure sensitive adhesives, suction cups, Velcro®, and snap-fit attachments, among others. The game pieces 16 are useable to represent players in their progress in the game. In an embodiment, game pieces 16 are also provided to enhance game play. For example, game pieces 16 that resemble money, option cards, houses, or any other accessories useable in game play can be provided.

In an embodiment, the game book 12 includes a storage container 18 disposed on the cover page 20 of the game book 12, or in any other location within the game book 12 or attached thereto. The storage container 18 is configured to hold the marking instruments 14 and/or the game pieces 16 when not in use. An eraser (not shown) might also be provided with the activity kit 10 and may be disposed within the storage container 18.

Referring again to FIG. 2, the game book 10 is depicted with an electronic component 28. The electronic component 28 includes any electronic device useable for game play. As depicted in FIG. 2, the electronic component 28 includes a liquid-crystal display 30, an actuation button 32, and associated processors, memory, integrated circuit boards and the like. The electronic component 28 is configured to generate a random pair of numbers similar to that which would be generated by rolling a pair of dice and to display an image 34 of a pair of dice depicting the generated numbers on the display 30. In another embodiment, the electronic component 28 is configured to generate any desired information, sounds, lights, or the like that are usable for game play. The electronic component 28 is integrated into a first page 22*a* of the game book 12. Subsequent pages 22*b* include a cut-out 36 that allows the electronic component 28 to pass through the subsequent pages 22*b* such that it can be viewed when the subsequent pages 22*b* are turned and can be housed within the game book 12 when the game book 12 is closed. Accordingly, multiple subsequent pages 22*b* may include cut-out 36 to allow enclosure of electronic component 28.

Figure 3:
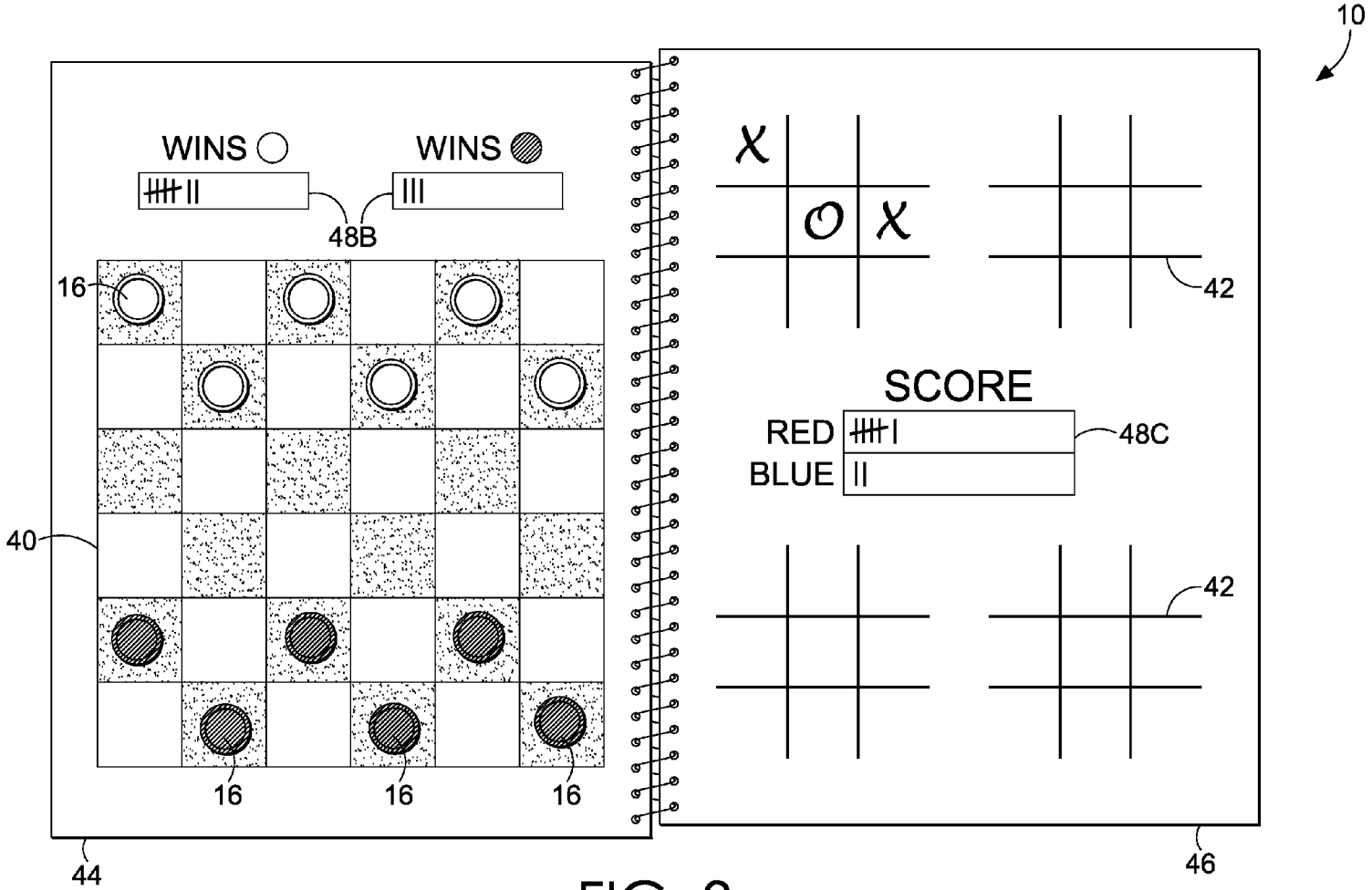
FIG. 3 is a perspective view of another dry-erasable game kit in accordance with an embodiment of the invention.

The pages 22*a-b* also include a game-board image 38 printed thereon. The game-board image 38 comprises any desired image associated with games now known or later developed. The game-board image 38 is a portion of a game board that is typically played in a circular fashion, e.g. players sit around a game board and play progresses around the perimeter of the game board in a circular pattern, although any game board of any configuration may be used. As depicted in FIG. 2, the game-board image 38 comprises a portion of the popular board game, Monopoly®, from Hasbro, Inc. of Pawtucket, R.I. The game-board image 38 is configured in a linear fashion and may continue onto subsequent pages 22*b*. Or for games such as checkers or tic-tac-toe, a game-board image 40, 42 for complete game play might be contained on a single page 44, 46 as depicted in FIG. 3. The pages 22*a-b*, 44, 46 might also include one or more sections 48*a-c* configured to aid players in keeping score or tracking game play. For example, sections 48*a-c* may be dry-erase surfaces labeled according to the score-keeping format of the corresponding game board image.

The game-board image 38 is also configured to decrease overall playtime required for game play as compared to the typical board game scenario. For example, the game might be modified to have a shorter duration such that it can be played to completion during an average car ride. Additionally, the game-board image 38 might also be configured to increase the speed of game play as compared to the typical board game scenario. Various modifications can be made to the game-board image 38 and/or in the rules for game play, such as condensing a number of tiles available for movement of a game piece 16 and limiting a number of moves from the rules provided in a full-length version of the game. These modifications may make the activity kit 10 more travel friendly.

With continued reference to FIG. 2, game play using the activity kit 10 is described in accordance with an embodiment of the invention. Initially a player opens the game book 12 to a starting page 22*a* of a desired game. The game book 12 may include a plurality of different games and types of games that are configured for one or a number of players. The player(s) obtain one or more game pieces 16 as required by a chosen game and place them on the game-board image 38 as appropriate for the selected game. In an embodiment, the game pieces 16 are obtained from the storage container 18 (seen in FIG. 1) and are magnetically coupled to the pages 22*a-b*. In another embodiment, the marking instruments 14 are used to track game play without the use of the game pieces 16. As depicted in FIG. 2, the chosen game is Monopoly®, and thus the players should each place their game piece 16 on the game-board image 38 in the "GO" square at the left of the image 38. As such, with the "GO" square being a part of a magnetic section 26, game pieces 16 remain in position on the game board image 38 until further movement of the game pieces 16 by a player.

Next, a first player depresses the button 32 on the electronic component 28 to generate a dice roll that is depicted in the image 34 on the display 30. In another embodiment, players might use another apparatus that is integral with or separate from the game book 12 to assist in game play. The first player moves his or her game piece 16 along the game-board image 38 according to the dice role indicated on display 30, and game play continues as appropriate for the selected game. Players may use the section 48*a* to track details associated with the game, such as purchases, money, scores, number of houses or hotels purchased, etc., by marking in the section 48*a* with the marking instruments 14. Players might also mark on any other portions of the pages 22*a-b* and game pieces 16 to further aid in tracking game play. For example, a player might draw an "X" on a section of the Monopoly® game board image 38 to indicate a property that the player has purchased.

As game play progresses, players continue to move their game pieces 16 across the game-board image 38. Upon reaching the end of the game-board image 38, game play ends. Alternatively, the game-board image 38 may continue onto underlying subsequent pages 22*b* and game play can continue. Once game play is complete, the players can erase any markings placed on the pages 22*a-b* and can begin again or choose a new game.

Play of the games depicted in FIG. 3 follows a similar process except that the games depicted do not continue onto subsequent pages. As such, players wishing to play checkers, as depicted on the page 44, simply obtain the appropriate game pieces 16 and place them on the game-board image 40 to begin play. The players can track the number of wins in the sections 48*b* using the marking instruments 14.

Players wishing to play tic-tac-toe, as depicted on the page 46, can obtain game pieces 16 for play or can use the marking instruments 14. Players track their wins in the section 48*c*.

Although embodiments of the invention are described above with respect to a selection of exemplary games and game-board images 38, 40, 42, such is not intended to limit embodiments to any particular games/game-board images. Embodiments of the invention can use any desired game or game-board image without departing from the scope described herein.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A travel game-board activity kit comprising:
a plurality of dry-erase marking instruments;
a plurality of magnetic game pieces;
a plurality of pages having one or more game-board images printed thereon, one or more magnetic sections, and a surface configured to accept markings from the plurality of dry-erase marking instruments and to allow erasure of the markings,
wherein each of the one or more game-board images corresponds directly to each of the one or more magnetic sections; and
an electronic component, wherein the electronic component is coupled to at least one of the plurality of pages.

2. The travel game-board activity kit of claim 1, wherein the marking instruments are one or more of dry-erase markers and dry-erase crayons.

3. The travel game-board activity kit of claim 1, wherein at least one of the marking instruments comprises a light source, and further wherein at least one of the plurality of pages is configured with one or more of photoluminescent and photochromic properties.

4. The travel game-board activity kit of claim 1, wherein the plurality of magnetic game pieces comprises one or more of a token, a medallion, and a miniature figurine.

5. The travel game-board activity kit of claim 1, further comprising at least one storage container disposed on a surface of the plurality of pages, the at least one storage container adapted to hold one or more of the plurality of dry-erase marking instruments and the plurality of magnetic game pieces within the storage container.

6. The travel game-board activity kit of claim 1, wherein the electronic component comprises a liquid-crystal display, an actuation button, and one or more of an associated processor, a memory, and an integrated circuit board.

7. The travel game-board activity kit of claim 6, wherein the electronic component is configured to generate one or more of desired information, sounds, and lights that are usable for game play.

8. The travel game-board activity kit of claim 7, wherein the electronic component is configured to generate a random pair of numbers corresponding to that which would be generated by rolling a pair of dice, and further wherein the electronic component is configured to display an image of a pair of dice depicting the generated pair of numbers on the liquid-crystal display.

9. The travel game-board activity kit of claim 1, wherein the electronic component is integrated into a first page of the plurality of pages, wherein subsequent pages include a cut-out that allows the electronic component to pass through the subsequent pages such that the electronic component can be viewed when the subsequent pages are turned, and further wherein the electronic component can be housed within the activity kit when the plurality of pages are closed.

10. The travel game-board activity kit of claim 1, wherein the surface configured to accept markings from the plurality of dry-erase marking instruments and to allow erasure of the markings comprises one or more dry-erase sections configured to aid players in tracking game progress, wherein the one or more dry-erase sections are labeled according to a score-keeping format of the corresponding one or more game board images.

11. A travel game-board activity kit comprising:
one or more dry-erase marking instruments;
one or more removeably attachable game pieces; and
a plurality of pages having a plurality of individual game-board images printed thereon, one or more attachment surfaces adapted to couple to the one or more game pieces, and a surface configured to accept markings from the one or more dry-erase marking instruments and to allow erasure of the markings,
wherein each of the plurality of individual game board images corresponds directly to each of the one or more attachment surfaces,
wherein at least one of the marking instruments comprises a light source, and further wherein at least one of the plurality of pages is configured with one or more of photoluminescent and photochromic properties.

12. The travel game-board activity kit of claim 11, wherein the one or more removeably attachable game pieces are magnetic, and further wherein one or more attachment surfaces are magnetic, such that the one or more game pieces are removeably and magnetically attachable with the one or more attachment surfaces.

13. The travel game-board activity kit of claim 11, wherein the one or more removeably attachable game pieces comprise one or more means for removable attachment to the plurality of pages, wherein the one or more means comprises one or more of pressure-sensitive adhesive, Velcro®, and snap-fit attachments, wherein the one or more attachment surfaces are adapted to couple to the one or more means for removable attachment of the one or more game pieces.

14. The travel game-board activity kit of claim 11, further comprising at least one storage container disposed on a surface of the plurality of pages, the at least one storage container adapted to hold at least one of the one or more dry-erase marking instruments and the one or more removeably attachable game pieces, wherein the storage container is coupled to a cover page of the game board activity kit.

15. The travel game-board activity kit of claim 11, further comprising an electronic component coupled to at least one of the plurality of pages,
wherein the electronic component comprises a liquid-crystal display, an actuation button, and one or more of an associated processor, a memory, and an integrated circuit board,
wherein the electronic component is configured to generate one or more of desired information, sounds, and lights that are usable for game play,
and further wherein the electronic component is integrated into at least one of the plurality of pages, wherein subsequent pages include a cut-out that allows the electronic component to pass through the subsequent pages such that the electronic component can be viewed when the subsequent pages are turned.

16. The travel game-board activity kit of claim 15, wherein the electronic component is configured to generate a random pair of numbers corresponding to that which would be generated by rolling a pair of dice, and further wherein the electronic component is configured to display an image of a pair of dice depicting the generated pair of numbers on the liquid-crystal display.

17. The travel game-board activity kit of claim 11, wherein the surface configured to accept markings from the one or more dry-erase marking instruments comprises one or more dry-erase sections configured to aid players in tracking game progress, wherein the one or more dry-erase sections are labeled according to a score-keeping format of the corresponding one or more game board images.

18. A travel game-board activity kit comprising:

a plurality of dry-erase marking instruments, wherein the marking instruments are one or more of dry-erase markers and dry-erase crayons;

a plurality of magnetic game pieces;

a plurality of pages having one or more game-board images printed thereon, one or more magnetic sections, and a surface configured to accept markings from the plurality of dry-erase marking instruments and to allow erasure of the markings, wherein the surface configured to accept markings from the plurality of dry-erase marking instruments comprises one or more dry-erase sections configured to aid players in tracking game progress, wherein the one or more dry-erase sections are labeled according to a score-keeping format of the corresponding one or more game board images; and an electronic component coupled to at least one of the plurality of pages, wherein the electronic component comprises a liquid-crystal display, an actuation button, and one or more of an associated processor, a memory, and an integrated circuit board, wherein the electronic component is configured to generate one or more of desired information, sounds, and lights that are usable for game play, and further wherein the electronic component is integrated into a first page of the plurality of pages, wherein subsequent pages include a cut-out that allows the electronic component to pass through the subsequent pages such that the electronic component can be viewed when the subsequent pages are turned.

* * * * *